United States Patent [19]

Meyer

[11] 4,305,461

[45] Dec. 15, 1981

[54] WELL PUMPING APPARATUS

[76] Inventor: Edward D. Meyer, 69 Nassau Point, Cutchogue, N.Y. 11935

[21] Appl. No.: 20,936

[22] Filed: Mar. 15, 1979

[51] Int. Cl.[3] ..... E21B 33/02

[52] U.S. Cl. ..... 166/84

[58] Field of Search ..... 166/315, 84; 74/41 R

[56] References Cited

U.S. PATENT DOCUMENTS

| | | | |
|---|---|---|---|
| 127,025 | 5/1872 | Carll | 166/84 |
| 129,129 | 7/1872 | Gretter | 166/84 |
| 245,101 | 8/1881 | Thayer et al. | 166/84 |
| 1,060,961 | 5/1913 | Waitz | 166/84 |
| 1,071,360 | 8/1913 | Shiery | 166/84 |
| 1,173,825 | 2/1916 | McNallen | 166/84 |
| 1,753,440 | 4/1930 | Miller | 166/84 |
| 2,137,853 | 11/1938 | Nixon | 166/84 |

*Primary Examiner*—James A. Leppink

*Attorney, Agent, or Firm*—Bauer & Amer

[57] ABSTRACT

A pumping apparatus that may be used with a well in which a sucker rod is connected with the well so as to remain in axial alignment with the same during shifting of the well and the sucker rod is supported clear of the well and the structure for operating the same.

16 Claims, 5 Drawing Figures

WELL PUMPING APPARATUS

BACKGROUND OF THE INVENTION

The present invention relates to a method and apparatus for pumping oil or other subsurface fluids from a well.

Pumping of oil and other fluids from relatively small wells is conventionally practiced using what is commonly referred to as a pump jack or walking beam apparatus. The walking beam is operated to reciprocate a sucker rod extending downwardly into the well casing and which is connected at its lower end with a downhole or deep well pump. Reciprocating the sucker rod actuates the downhole pump and results in an upward pumping of the oil through the well casing.

The walking beam essentially comprises an arm or beam pivotally mounted substantially perpendicular to the sucker rod and connected therewith at the upper end of the sucker rod remote from and externally of the well casing. Since the sucker rod may extend 3,000 feet or more to the bottom of the well casing, the same has considerable mass and reciprocating the sucker rod consequently requires a relatively large and heavy walking beam arm as well as a substantial source of power for moving the same. Operating such large mechanisms clearly necessitates the expenditure of considerable amounts of energy and can be dangerous to people working in the area and damaging to the immediate environment.

The size of the pump jack or walking beam mechanism utilized in connection with a well is selected according to the depth of the wall; the deeper the well, the larger the size of the pump jack. Should pumping operation of the well indicate that its depth must be increased for maximum return of oil, it might be necessary to replace the walking beam with another at great cost and with a significant loss of pumping time and consequently of oil recovery.

In addition, use of a walking beam apparatus requires that the same be initially ground-levelled relative to the well casing so that when the beam's pivoting arm reciprocates the sucker rod, maximum moving force is transmitted from the beam by way of a direct center line or axial pull on the sucker rod. Relatively minor misalignment may result in, inter alia, breakage of the sucker rod within the well casing where the break is difficult to locate and to reach for repair, degeneration of the various well closure and anticontamination seals and consequent scoring of moving portions of the pumping apparatus including the polishing rod associated with the sucker rod, and possible damage to the well casing and head. This alignment problem is particularly important because ground movement as by shifting or swelling often occurs during subsurface fluid pumping, causing angular or lateral shifting or bending of the well casing. In such cases, pumping operations must be halted while the walking beam is relevelled and rebalanced so as to prevent breaking of the sucker rod which is otherwise likely to occur. Halting of pumping, due to sucker rod breakage or the need to remount or rebalance the pump jack, is extremely costly to the well owner or operator.

It is the desideratum of the present invention to provide a pumping rig for supported connection with the well casing of an oil well to enable the pumping rig to automatically remain aligned with the well casing in the event of angular or lateral shifting of the well casing and thereby prevent breakage or rupture of the operating mechanism of the pumping rig caused by non-alignment therewith.

In particular, it is an object of the present invention to provide an oil pumping rig in which the axial alignment of the sucker rod relative to the well casing is automatically maintained should the position of the well casing shift.

It is another object of the present invention to provide a pumping rig in which the sucker rod is supportedly suspended at its end remote from the well casing and is unconnected with the rig at any other point along the length of the sucker rod.

It is a further object of the present invention to provide a pumping rig in which the reciprocally movable sucker rod is relatively laterally spaced from the rig along its entire length other than at a single connection with an actuating means for reciprocating the same so as to permit the sucker rod to flex, distort or move laterally and to bend along its length without constriction.

It is still another object of the present invention to provide a fluid-operated pumping apparatus for actuating deep well pumps which is compact, portable and relatively inexpensive to manufacture and operate.

Further objects, features and advantages of the present invention will be more fully appreciated by reference to the following detailed description of a presently preferred, but nonetheless illustrative embodiment in accordance with the present invention, when taken in conjunction with the accompanying drawings, wherein.

DETAILED DESCRIPTION OF THE PREFERRED EMBODIMENT

Figure 1:
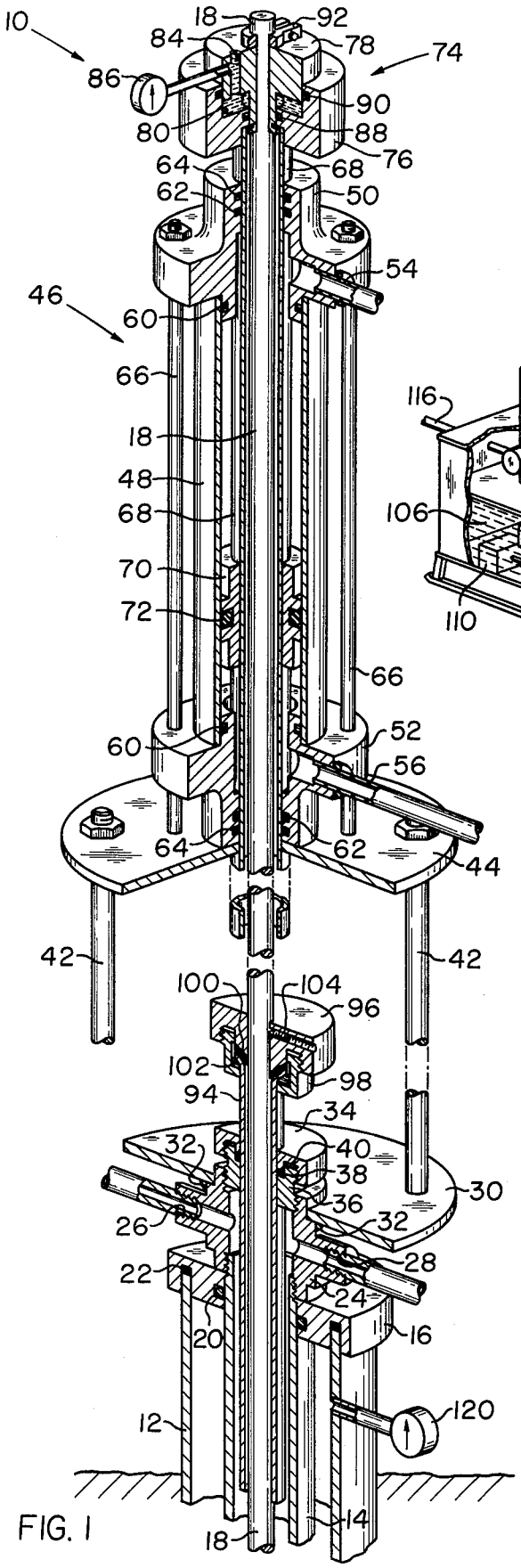
FIG. 1 is an elevational view, partially broken away, of a pumping apparatus in accordance with the present invention and operatively connected with a well casing.

Turning now to the drawing, there is seen in FIG. 1 a preferred embodiment of a pumping apparatus, designated by the general reference numeral 10, constructed in accordance with the teachings of the present invention. The apparatus 10 is utilized in conjunction with a typical small-scale well which includes an outer well casing 12 peripherally spaced about an inner well casing 14 concentric therewith. The outer and inner casings 12, 14 are spacedly connected at their uppermost ends which project from the ground surface by a well casing head 16, the head 16 also forming an upper end closure for seal of the outer well casing 12. The concentricity or lateral spacing apart of the outer and inner well casings 12, 14 may be further maintained along the full extent of their lengths by the provision of spacing members (not shown) distributed at selected intervals therealong.

A sucker rod 18 extends in and through the inner casing 14 of the well and is connected at its lowermost end with a downhole pump (not shown) at the well bottom operable for pumping subsurface fluids such as oil therefrom. Although the apparatus 10 of the present invention is, for purposes of convenience, specifically described in relation to the recovery of oil, those skilled in the art will readily recognize that virtually any subsurface fluid may be pumped from a well therewith. The sucker rod 18 projects upwardly out of the well through the well head 16 for connection with and reciprocating actuation or movement by the pumping apparatus 10 in a manner soon to be described for operation of the downhole pump. It will be seen in FIG. 1 that the sucker rod 18 is laterally spaced from the interior defines of the encircling inner well casing 14 and it will become evident as this description proceeds that this lateral relative spacing about the sucker rod 18 is maintained along its length as the sucker rod extends upwardly from the concentric well casings 12, 14 to its connection with the pumping apparatus 10.

The inner well casing 14 extends through the casing head 16 where an O-ring seal 20 about the casing 14 is provided for preventing fluid leakage from the interior thereof. Packing 22 at the joinder of the outer casing 12 and well head 16 serves a like function with respect to the outer casing 12. The well head 16 supports a tee or pipe cross 24 which may be threadedly secured to the inner well casing 14 and includes outlets 26, 28 on the extending arms thereof. An interior opening or passage through the tee 24 with which the outlets 26, 28 communicate is predeterminately sized to permit free and unrestricted passage of the sucker rod 18 therethrough while providing for lateral spacing about the sucker rod relative to the encircling tee member.

The tee 24 is further seen to include a supporting flange or shoulder on which is carried a lower support or base plate 30. The base plate 30 may be butt welded to the tee 24 as at 32 to prevent shifting or other undesired relative movement therebetween. The tee 24 extends beyond its supporting shoulder through a central opening in the lower base plate 30 and is there connected with a retaining end cap 34 by way of a threaded connecting link 36. The retaining cap 34 is provided with a central opening substantially aligned with that of the tee 24, and through which the sucker rod 18 extends, and carries a packing gland 38 adjacent the interior wall of the opening. A seal 40 interposed between the retaining cap 34 and connecting link 36 guards against fluid leakage at that point from the interior of the inner well casing 14.

A plurality of support rods 42 are bolted or otherwise secured to the lower base plate 30 and fixedly carry on their upwardly disposed ends an upper base plate 44. Thus, the rods 42 rigidly connect the lower and upper plates 30, 44 so as to maintain the same substantially parallel and aligned with one another at all times. As a consequence, any positional change or shift of the lower plate 30 is immediately transferred to and adopted by the upper plate 44 to maintain their relative alignment.

The upper plate 44 in turn supports and carries a fluid-operated sucker rod actuating means generally designated 46 which will now be described. It should, however, be recognized at the outset of such description that the upstanding actuating means 46 is supported and maintained in alignment with the well casings 12, 14 and with the remainder of the pumping apparatus 10 solely by reason of the relative alignment of the lower and upper base plates 30, 44 as rigidly connected by the support rods 42. Thus, it is essential that the rods 42 be formed and arranged to effectively maintain the substantially parallel, spaced relation of the plates 30, 44.

The sucker rod actuating means 46 comprises an elongated hollow cylinder or housing 48 capped at its ends by upper and lower closure heads 50, 52 respectively. Each of the closure heads 50, 52 includes a centrally-defined passage through which the sucker rod 18 freely and laterally spacedly extends and an inlet-outlet conduit 54, 56 in communication with the interior passage through the respective closure head. During operation of the pumping apparatus 10 hydraulic fluid is directed through the conduits 54, 56 from a reservoir and hydraulic pumping unit seen in FIG. 2 and generally designated 58 which will hereinafter be described.

The upper and lower closure heads 50, 52 each additionally carry O-ring seals 60, 62, for preventing leakage of hydraulic fluid from the interior of the cylinder 48, and a lubricating wiper 64 adjacent their central throughpassages. A plurality of vertically-disposed tie rods 66 are bolted or otherwise secured at their opposite ends to the upper cylinder head 50 and the upper base plate 44 and are tightly journalled through the lower closure head 52. The provision of the tie rods 66 contributes to the rigidity of the arrangement whereby the cylinder 48 and its end closure members are supportedly maintained upstandingly atop the upper base plate 44 in substantial alignment with and relative to the lower base plate 30 and well casings 12, 14.

A ram 68 comprising a hollow tubular member and unitarily carrying a piston 70 peripherally disposed intermediate its ends is positioned for sliding movement within and through the interior of the cylinder or housing 48. The tubular ram 68 is cross-sectionally sized for sliding movement against the interior surface of the cylinder closure head throughpassages at the seals 62 whereby the seals complete a fluid-tight closure between the respective closure head 50, 52 and the relatively slidable tubular ram 68 so as to prevent fluid escape from within the cylinder 48. The wipers 64 are similarly effective to prevent the passage of dirt or surface-scoring contaminants into the interior of the ram cylinder or housing 48 and may further lubricate the ram 68 as the same slides against the closure heads 50, 52. The outermost periphery of the piston 70 is arranged to ride along the interior surface of the ram housing 48 and carries a pressure seal 72 of Teflon or the like which firmly contacts the housing interior wall to enable the accumulation of hydraulic operating pressure above or below the piston 70 and for lubricating the housing surface against and along which the piston rides. As seen in FIG. 1, the sucker rod 18 passes coaxially through the interior of the tubular ram 68 from which the sucker rod is laterally spaced as previously described.

Figure 4:
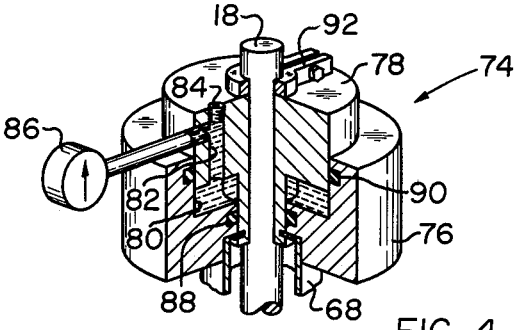
FIG. 4 is an elevational sectional view of the load sensing means of the pumping apparatus of FIG. 1.

Connection of the ram 68 with the sucker rod 18 for effecting reciprocating motion of the sucker rod is provided at a load sensing apparatus and clamping assembly generally designated 74 and seen in enlarged detail in FIG. 4. The load sensing apparatus 74 consists of a two member interlocking piston-type arrangement comprising a piston head 76 resting unattachedly atop the tubular ram 68, and a piston body 78 relatively movably disposed atop the piston head 76 and set at least partially within an interior cavity 80 defined in the piston head 76. The cavity 80 contains a quantity of a substantially incompressible fluid such as oil; a bore 82 in the piston body 78 through which the oil or other fluid may be fed into the cavity 80 is closed with a plug 84. A pressure guage 86 in communication with the incompressible fluid within the cavity 80 indicates the force exerted on the fluid and provides a pressure-associated load reading by virtue of the relative positions of the piston head and body 76, 78. Leakage of the incompressible fluid from within the cavity 80 which might otherwise occur between the piston head and body 76, 78 when the fluid is placed under pressure during operation of the pumping apparatus 10 is prevented by O-ring seals 88, 90 carried by the piston head 76.

Ther sucker rod 18 is journalled upwardly through a central opening of the piston body and is retained in position relative thereto by way of a rod clamp 92 tightened about the sucker rod 18 at the top of the body 78. It will be recognized that because the rod clamp 92 is larger than the central opening in the piston body 78 through which the sucker rod 18 passes, the sucker rod is longitudinally fixed atop and suspended from the load sensing apparatus 74 without actually being secured thereto and its weight maintains the nested position of the piston rod 78 atop and partially within the cavity 80 of the piston head 76. The sucker rod 18 is accordingly prevented from moving downward relative to the load sensing apparatus 74 past the point at which the clamp 92 is secured thereto, and at the same time the nested arrangement of the piston body 78 atop and partially within the piston head 76 is retained.

This structural relationship and arrangement by which the piston head 76 unattachedly rests or sits atop the tubular ram 68 and by which the sucker rod 18 is positionally fixed or clamped relative to the piston body 78 without actually being attached or connected thereto provides significant operating advantages which will be understood and appreciated as this description proceeds. However, it should now be clear that the sucker rod 18 is essentially unconnected with the pumping apparatus 10 along the entirety of its length with the sole exception of the rod clamp 92 grippingly positioned thereabout at the top of the pumping apparatus 10. In addition, throughout its unconnected length and extent the sucker rod 18 is laterally spaced apart from the structures and members through which the same passes and it will hereinafter be further understood and appreciated that such lateral spacing permits the sucker rod to flex laterally and to bend along its length without constriction at any point thereof, with the exception of its connection at the clamp 92, so as to substantially prevent breakage of the sucker rod 18 at locations within the pumping apparatus 10 or, more importantly, within the inner well casing 14 where the break may be extremely difficult and time consuming to locate and repair.

Figure 5:
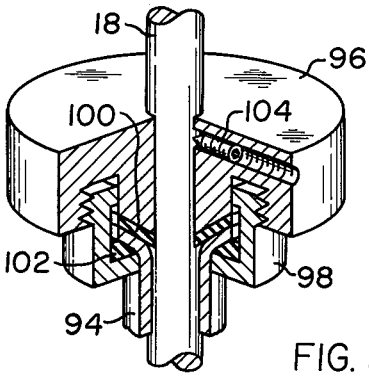
FIG. 5 is an elevational sectional view of the polishing rod clamping means of the pumping apparatus of FIG. 1.

Of course, in order to maintain a seal or closure of the inner well casing 14 at its upwardly disposed end where the outwardly extending portion of the reciprocally movable sucker rod 18 passes from the well, sealing contact of some kind must be maintained about the reciprocally movable structure extending from the well. However, as has been previously emphasized, the present invention seeks to maintain a lateral spacing about the sucker rod 18 throughout its entire length with the exception of its connection with the clamp 92. A polishing rod 94 is therefore provided about the sucker rod in the area of its extension through the cap member 34 which closes the inner well casing 14 and through which the sucker rod 18 extends from the well. The polishing rod 94 is laterally spaced about the sucker rod 18 and is connected therewith at a single point exterior of the well by way of a clamping member 96. The connection of the polishing rod 94 about the sucker rod 18 is seen in enlarged detail in FIG. 5.

The polishing rod 94, which may be formed by way of example of brass or stainless steel, is provided with a smooth, polished periphery and is flared at its upper end to facilitate a gripped retention of the same between the clamping member 96 and a retainer 98, each of which may be threaded for mutual securement to the other. The flared end of the polishing rod 94 may be braced between appropriately configured packing seals 100, 102 to assure a substantially fluid-tight engagement between the polishing rod 94 and the clamping member 96 and retainer 98. Positional fixing and retention of the polishing rod 94 at the desired point along the length of the sucker rod 18 may be easily accomplished and readjusted as necessary by the use of a set screw 104 threaded into the member 96 and against the sucker rod 18.

Thus, the polishing rod 94, reciprocally movable with the sucker rod 18, slidably rides against the interior opening or passage through the well cap 34 in which is retained a packing gland 38 of fibrous material as graphite and asbestos or the like. The sucker rod 18 remains laterally inwardly spaced from the interior wall of the well cap 34. The sealing of the flared end of the polishing rod 94 between the mating clamping member 96 and retainer 98 insures against fluid leakage between the polishing rod 94 and the sucker rod 18 at their mutual connection externally of the well. Moreover, since the sucker rod 18 is laterally spaced within the polishing rod 94 (with the exception of its connection at the clamping member 96) and because the clamping member 96 is positioned on the sucker rod 18 remote from the point of sliding contact between the polishing rod 94 and the well cap 34, such sliding contact does not inhibit or constrict the sucker rod 18 against lateral flexing or bending in the area of its entry into the interior of the well. In other words, the connection of the polishing rod 94 on the sucker rod 18 is performed at a point along the length of the sucker rod at which there are no surrounding structures to restrict or otherwise interfere with the reciprocating sucker rod motion. The sucker rod is therefore able to laterally flex and bend without constriction in the area of its connection with the polishing rod 94.

As a consequence, the sucker rod 18 is for all intents and purposes laterally spaced from all of the structures or members comprising the pumping apparatus 10 and the well itself with the single exception of its suspended connection by way of the rod clamp 92 at the top of the pumping apparatus 10. The sucker rod 18 need not extend upwardly beyond its attachment with the rod clamp 92 although it will hereinafter be understood that an extension therebeyond will not affect operation of the pumping apparatus 10 and is therefore permissible. In any event, since sucker rods of the type utilized with the present invention are typically fabricated in rods of discrete length which are subsequently connected together at the operational site until the required overall length is attained, the sucker rod 18 may be easily lengthened as necessary merely by attaching to the uppermost termination or end thereof an additional length of rod.

Figure 2:
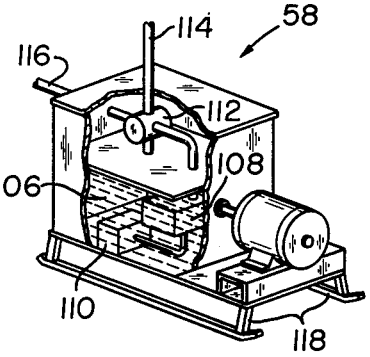
FIG. 2 is a perspective elevational view, partly broken away, of a reservoir and hydraulic pumping unit for use with the apparatus of the present invention.

In use, the pumping apparatus 10 is connected with a fluid reservoir and hydraulic pumping unit, as for example that designated 58 in FIG. 2. The unit 58 includes a reservoir 106 of hydraulic fluid such as an oil which is moved by way of a motor-operated variable-volume hydraulic pump 108 through an oil filter 110 into a four-way sequencing valve 112 from which the hydraulic fluid is distributed through one of the conduits 114, 116. The other conduit is utilized as a return for fluid so as to form a closed system whereby the fluid is replaced in the reservoir 106 after use. Thus, by way of example, the conduit 114 may be attached by way of a hose or piping to the conduit 54 of the upper cylinder closure head 50, while the pipe 116 may be connected to the conduit 56 of the lower cylinder closure head 52. Mounting of the self-contained hydraulic pumping unit 58 on skids 118 or the like enables the unit 58 to be easily moved about and positioned relative to the oil well and pumping apparatus 10.

The pumping apparatus 10 is attached to and fixedly positioned atop the outer and inner well casings 12, 14 in the manner shown in FIG. 1 and previously described. It should be recognized that the entire pumping apparatus 10 is supported over the well casings and there is no other supporting connection of the pumping assembly 10 with the ground surface or with any structures secured to or carried on the ground. Thus, there is no need to initially level or balance the pumping apparatus 10 on or relative to the ground surface and any lateral or angular shifting of the well casings is automatically transmitted to the pumping apparatus 10 through, inter alia, the support rods 42 and tie rods 66 so as to maintain the apparatus aligned at all times with the concentric well casings 12, 14.

As is well understood among those skilld in the art, subsurface gas in the well accumulates and builds up pressure within the closed outer well casing 12 and the accumulated gas pressure is utilized to force oil, or whatever subsurface fluid is to be taken from the well, upwardly within and through the inner well casing 14. The oil is taken or collected from the well through the discharge outlet 26 in the tee or pipe cross 24. For a given well, a finite and readily ascertainable magnitude or amount of gas pressure is minimally required to provide a normal upward flow and discharge of oil through the inner casing 14. A pressure gauge 120 in communication with the interior of the outer well casing 12 may be provided for indicating the pressure of the contained gas therein. The second outlet 28 extending from the tee 24 may be connected with a pressure control valve (not shown) and utilized for bleeding oil or gas from the well.

Thus,, discharge of oil from the well proceeds unassisted by mechanical means when the gas within the outer well casing 12 remains at or above the minimally-required pressure. However, when the gas pressure drops below the level sufficient to automatically induce normal oil discharge through the outlet 26, the pumping apparatus 10 may be operated to mechanically induce oil flow from the well. Means for mechanically or otherwise sensing the pressure within the well and for automatically initiating operation of the pumping apparatus 10 are not shown but are considered to be within the skill of one versed with the art.

Flow of oil through the discharge outlet 26, in the absence of gas pressure within the outer well casing 12 sufficient to induce such flow, is accomplished by effecting reciprocating motion of the sucker rod 18 so as to operate the downhole pump within the well and thereby force or pump the oil upwardly through the inner well casing 14 and the discharge outlet 26. The sucker rod 18 is reciprocated in the pumping apparatus 10 by operation of the actuating means 46. That is, hydraulically induced reciprocating movement of the tubular ram 68 is transferred to the sucker rod 18 at their mutual connection through the load sensing apparatus and clamping assembly 74 to operate the downhole pump and force oil from the well.

Operation of the actuating means 46 is initiated from the position shown in FIG. 1 by activating the hydraulic pumping unit 58 so as to cause the same to pump hydraulic fluid into the conduit 56 of the lower cylinder head 52. The hydraulic fluid is forced and flows under pressure into the lower interior of the ram housing 48 and against the piston 70 unitarily attached to the tubular ram 68. The fluid must be provided under sufficient pressure to lift or carry the piston 70, and with it the ram 68 and the load sensing apparatus 74 resting atop the tubular ram 68, upward ahead of the rising column of hydraulic fluid. Inasmuch as the sucker rod 18 is clamped atop the piston body 78 of the load sensing apparatus 74, the sucker rod 18 is correspondingly carried upward with the ram 68 and its unitary piston 70.

Figure 3:
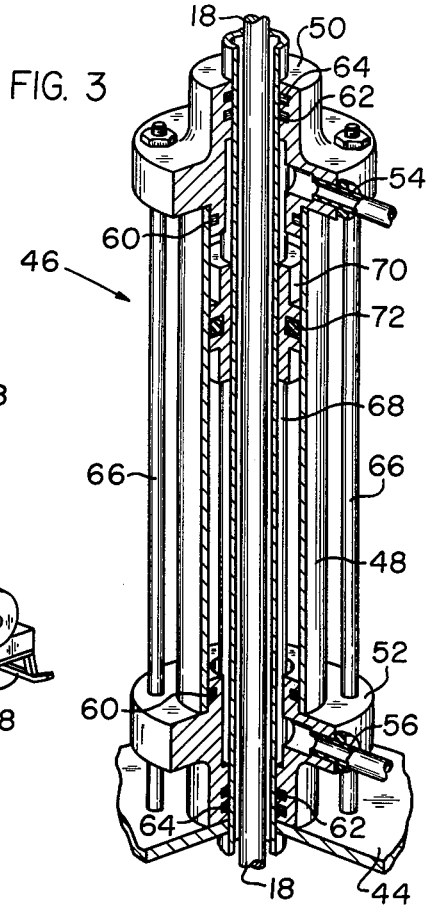
FIG. 3 is an elevational sectional view of the fluid-operated actuating means of the pumping apparatus of FIG. 1 seen in its topmost position.

When upward movement of the ram 68 has lifted the piston 70 substantially to the raised position shown in FIG. 3, position sensing means (not shown) or the like causes the valve 112 to sequence and reverse its mode of operation so that the hydraulic fluid is thereafter channeled or fed under pressure into the conduit 54. In this reverse mode the conduit 56 is utilized as a return for the hydraulic fluid previously pumped into the lower end of the ram housing 48 and now forced from the housing by the decending piston 70. The ram 68, and with it the sucker rod 18, is thus lowered until the same return to their original positions seen in FIG. 1.

It should be recognized that in any type of pumping apparatus utilizing a reciprocably-movable sucker rod extending into the well for operating a downhole pump, the downstroke movement of the sucker rod will be greatly influenced and, in fact, to a great extent controlled, by the force of gravity acting on the sucker rod. In prior art walking beam pumping devices, the cogs on the gears which cause movement of the beam arm are utilized to partially counteract or offset the significant effect of gravity on the sucker rod during its downstroke so as to prevent the sucker rod from banging or bottoming against the downhole pump. However, as the gear cogs normally wear during continued operation of the walking beam apparatus, destructive bottoming of the sucker rod against the downhole pump inevitably occurs with increasing frequency and severity, often resulting in damage to both.

In the apparatus 10 of the invention pumping unit, the action of gravity on the sucker rod 18 will likewise greatly contribute to its downward movement as the hydraulic fluid below the piston 70 is evacuated through the conduit 56 from the interior of the ram housing 48. However, because the piston 70, and with it the ram 68, cannot move downward within the ram housing 48 until the hydraulic fluid is evacuated from below the piston through the outlet conduit 56, the speed and length of the downstroke of the sucker rod 18 may be effectively controlled by controlling the rate at which the hydraulic fluid is permitted to exit through the conduit 56. In other words, the downstroke of the sucker rod 18 may be slowed, against the force of gravity acting thereon and naturally accelerating the same downward, so as to prevent the sucker rod from bottoming or banging against the downhole pump with possible damage to both. This controlled evacuation of the hydraulic fluid through the outlet conduit 56 may be effected in any conventional manner as, by way of example only, the provision of a restrictive valve inserted between the outlet 56 and the return pipe 116 of the hydraulic pumping unit 58 or incorporated within the sequencing valve 112.

When the ram-carried piston 70 has been returned from its raised FIG. 3 to its lowered FIG. 1 position, the sequencing valve 112 may be once again operated to initiate upward movement of the ram 68 and sucker rod 18. By continued sequencing of the valve 112 in this manner, reciprocating movement of the sucker rod 18 is provided so as to operate the downhole pump and thereby pump oil from the well.

The load sensing apparatus 74 provides, by way of the pressure gauge 86, a reading or indication of the lift load on the sucker rod 18. That is, the readings on the gauge 86 represent direct pressure loads of the upstroke movement of the sucker rod 18, and consequently of the downhole pump at the bottom of the well. The reading or indication on the pressure gauge 86 should remain substantially constant during operation of the pumping apparatus 10. Any significant variation is an immediate indication of a problem related to the reciprocating movement of the sucker rod or of the downhole pump. Thus, if the gauge 86 suddenly indicates a significant increase from its normal or substantially constant reading, the sucker rod 18 may be fouled somewhere along its length or there may be a like problem with the downhole pump whereby movement of the same is inhibited. The result, uncorrected, could be breakage or other damage to the sucker rod 18.

On the other hand, should the reading on the pressure gauge 86 suddenly drop, indicating that a significantly decreased force is sufficient to raise the sucker rod, it may be necessary to lengthen the extension of the sucker rod into the well for proper operation of the downhole pump. This adjustment may be easily performed by loosening the engagement of the rod clamp 92 about the sucker rod 18 so as to permit its further extension into the well as required. The clamp 92 may thereafter be retightened about the repositioned sucker rod 18.

Thus, it should be appreciated that the construction of the pumping apparatus 10 of the present invention provides for particular ease of adjustment in the length or extension of the sucker rod 18 into the well by way of the clamp 92. Equivalent ease of sucker rod adjustment is not present in known prior art constructions. At the same time, the load sensing apparatus 74 through which the sucker rod 18 is reciprocated by the actuating means 46 provides for the operators of the pumping apparatus 10 of the present invention an instantaneous indication, by way of the pressure gauge 86, of an incorrect or problematical extension length adjustment of the sucker rod 18 into the well casing. Clearly, an automatic sensing means could be utilized in lieu of the visually-read pressure gauge 86 to provide for an automatically-initiated warning of rapid change in the sucker rod lift load.

The construction and arrangement of the structures forming the pumping apparatus 10 can thus be understood to present an efficient, portable well pumping unit in which the possibility of breakage or other damage to the sucker rod 18 is effectively minimized. The sucker rod 18 is laterally spaced from all of the structures and elements through which the same passes for its entire length with the exception of its uppermost end where the sucker rod is engaged by the rod clamp 92 for actuation by the reciprocating ram 68. By virtue of this lateral spacing, the sucker rod is permitted to flex laterally and to bend along its length without constriction at any point therealong.

Reciprocating motion of the sucker rod 18 is effected from its topmost end and, because the entire pumping apparatus 10 is supported atop the well casings 12, 14 and is therefore automatically maintained in alignment therewith, the lower portion of the sucker rod within the well and the upper portion within the pumping apparatus 10 are always kept in substantially straight-line relation to each other. As a consequence, lifting of the sucker rod 18 from its topmost end lifts the entire sucker rod axially along a straight line, while downward movement of the sucker rod is correspondingly directed straightwise along its length. In other words, the direct center-line pulling or pushing of the sucker rod 18 provided by the present inventive apparatus assures that the maximum operating force provided by the actuating means 46 is delivered to the sucker rod 18 throughout and along its length. This direct center-line force transmittal is provided independently and irrespective of any lateral or angular shifting of the well casings 12, 14 resulting from movement of the ground in which the well is located.

Moreover, the only portion of the sucker rod 18 that is under any breaking stress is at its clamped connection at the top end thereof. But stress on the sucker rod 18 at the clamp 92 is distributed substantially over the length of the sucker rod due to its lateral spacing within and from the interior of the ram housing 48 and the other structural elements or members through which the rod passes. This lateral spacing permits the sucker rod to shift laterally or transversely along its length so as to absorb and compensate for stresses acting thereon.

The result is that forces on the sucker rod 18 which might cause the same to break are most likely to cause the break to occur externally of the well casings and close to its clamped connection adjacent the load sensing apparatus and clamping assembly 74. Repair of the sucker rod, in the event of such breakage, is thereby significantly facilitated since access to the sucker rod in the vicinity of the break is assured. A new section of sucker rod need merely be attached just below the point of breakage and pumping of the well can be reinstituted in a relatively short time period.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In an apparatus for connection with a well casing, a sucker rod extending into the well casing for reciprocal operation therein, fluid operated means to cause the reciprocation of said sucker rod for operation in the well casing, said sucker rod extending through and beyond said fluid operated means, and means connecting said sucker rod to the apparatus exterior of the well casing at a position on said sucker rod remote from the well casing and beyond said fluid operated means to permit said sucker rod to have lateral movement along its length within said fluid operated means.

2. In an apparatus according to claim 1, said connection of said sucker rod with the apparatus being at an end of said sucker rod exterior of the well casing so as to position said fluid operated means between the well casing and said sucker rod end.

3. In an apparatus according to claim 1 wherein said sucker rod is alternately reciprocally movable by said fluid operated means through an upstroke and a downstroke, said fluid operated means including means for controlling the downstroke of said sucker rod against the force of gravity acting on said sucker rod in said downstroke.

4. In an apparatus according to claim 1, said connecting means connecting said fluid operated means with said sucker rod at an end of said sucker rod.

5. In an apparatus according to claim 4, said fluid operated means being laterally spaced from said sucker rod for the full extent of said fluid operated means such that said connecting means is the sole connection between said fluid operated means and said sucker rod.

6. In an apparatus according to claim 1, said fluid operated means comprising:

tubular ram means having a hollow interior throughout its length and through which hollow interior a portion of said sucker rod exterior of the well casing extends, and piston means integral with said ram means for enabling axially reciprocating movement of said ram means for causing reciprocal operation of said sucker rod.

7. In an apparatus according to claim 6, said sucker rod being spaced from the interior of said ram means throughout the length of said ram means to permit said sucker rod to move laterally without constriction at any point within said tubular ram means.

8. In an apparatus according to claim 6, said connecting means connecting said ram means at an end of said sucker rod exterior of the well casing.

9. In an apparatus according to claim 6, a hollow ram housing within and relative to which said ram means is reciprocally movable and against the hollow interior of which said piston means rides from reciprocal operation of said ram means.

10. In an apparatus according to claim 9, alignment means connecting said ram housing and the well casing for supporting said ram housing on the well casing and axially aligning said ram housing with the well casing so that the portion of said sucker rod exterior of the well casing is maintained in substantially straight-line relation with the remainder of said sucker rod within the well casing, said straight-line relation of said sucker rod by reason of said alignment means connecting the well casing and said ram housing being effective to reduce excessive wear and breakage of said sucker rod during reciprocal operation thereof in the event of lateral or angular shifting of the well casing.

11. In an apparatus for connection with a well casing, a hollow elongated housing, means supporting said housing on the well casing so as to maintain said housing in substantial axial alignment with the well casing, hollow ram means extending through the hollow interior of said housing and operable for reciprocating movement relative thereto, means for axially aligning said ram means concentrically within said housing, a sucker rod reciprocally movable within the well casing and extending outwardly therefrom and laterally movable in the hollow interior of said ram means such that said ram means is positioned between the well casing and an end of said sucker rod remote from the well casing, and means connecting said ram means with said remote end of said sucker rod for effecting reciprocal movement of said sucker rod within the well casing and for supporting the remote end of said sucker rod exterior of the well casing such that the sucker rod is in substantially a straight-line disposed within the well casing so that the sucker rod is maintained in axial alignment with the well casing.

12. In an apparatus according to claim 11, said connecting means connecting said sucker rod with said ram means at said remote end of the sucker rod.

13. In an apparatus according to claim 12, said means connecting said sucker rod and said ram means being the only connection of said sucker rod with the apparatus so that the sucker rod is effectively suspended from said connecting means for free and unhindered reciprocal movement of said sucker rod.

14. In an apparatus according to claim 11, said ram means including integral piston means sealably engaging the interior of said housing for sliding movement along said housing interior to effect reciprocal movement of said ram means relative to said housing by the introduction of fluid pressure into said housing.

15. In an apparatus according to claim 11, said means connecting said sucker rod and said ram means being the only connection of said sucker rod with the apparatus and said sucker rod being laterally spaced from the interior of said hollow ram means and the well casing to permit said sucker rod to flex laterally and to bend along its entire length without constriction at any point thereof therewithin.

16. In an apparatus according to claim 14, said connecting means including load sensing means for indicating loading on said sucker rod during movement of the same outwardly of the well casing.

* * * * *

UNITED STATES PATENT AND TRADEMARK OFFICE

CERTIFICATE OF CORRECTION

PATENT NO. : 4,305,461

DATED : December 15, 1981

INVENTOR(S) : EDWARD D. MEYER

It is certified that error appears in the above-identified patent and that said Letters Patent are hereby corrected as shown below:

IN THE CLAIMS:

Claim 9, line 5, change "from" to --for--

Claim 11, line 25, delete second use of "the" and substitute --said--

Signed and Sealed this

*Sixteenth* Day of *February 1982*

[SEAL]

*Attest:*

GERALD J. MOSSINGHOFF

*Attesting Officer*

*Commissioner of Patents and Trademarks*